United States Patent [19]

Eckert

[11] 4,002,343

[45] Jan. 11, 1977

[54] PUTTER POINTER

[76] Inventor: Albin F. Eckert, 5068 Scotsman Drive, Dayton, Ohio 45414

[22] Filed: July 7, 1975

[21] Appl. No.: 593,701

[52] U.S. Cl. ..... 273/163 R; 273/183 D

[51] Int. Cl.[2] ..... A63B 53/00

[58] Field of Search ..... 273/77 R, 163 R, 163 A, 273/164, 165, 162 R, 183 R, 183 D, 183 E, 186 R, 186 A, 186 D, 186 E, 193 R, 194 R, 194 A, 194 B

[56] References Cited

UNITED STATES PATENTS

| | | | |
|---|---|---|---|
| 2,670,209 | 2/1954 | Fay | 273/194 A X |
| 2,995,376 | 8/1961 | Leo | 273/194 A X |
| 3,198,525 | 8/1965 | Smith | 273/163 R |
| 3,292,928 | 12/1966 | Billen | 273/163 R |
| 3,298,693 | 1/1967 | Eisenberg | 273/194 R X |
| 3,489,415 | 1/1970 | Smith | 273/194 R X |
| 3,698,093 | 10/1972 | Marshall | 273/163 R X |
| 3,848,873 | 11/1974 | Linning | 273/194 R X |
| D111,855 | 10/1938 | Moreno | 273/163 R X |
| D150,497 | 8/1948 | Forsell | D34/5 CB |
| D188,677 | 8/1960 | Thornson | 273/163 R X |

*Primary Examiner*—Richard J. Apley
*Attorney, Agent, or Firm*—Jerome P. Bloom

[57] ABSTRACT

A direction pointer or indicator for removable attachment to the head of a golf club. A plate-like member projects forwardly of and in a relatively elevated relation to a golf club head and includes both an aperture by which an underlying ball can be seen and forwardly and rearwardly directed pointers to indicate a correct path of movement for the club head in striking the ball. The direction pointer has a light weight, one-piece and inexpensive construction and is readily mounted on and removed from the golf club head with no modification of the club head required.

10 Claims, 5 Drawing Figures

No. 4
No. 2
G

PUTTER POINTER

BACKGROUND OF THE INVENTION

This invention relates to golf club attachments and particularly to a directional pointer which when mounted on a golf club, particularly a putter, assists the golfer in stroking the club in a true line from the face of the club toward the hole on the golf green.

Direction indicator attachments for golf clubs have been known heretofore but in forms which to golfers present certain disadvantages. Thus, known devices are relatively complex and therefore costly. In some instances the golf club head must be specially machined or modified to be fitted with an indicator attachment. Also, known devices add non-symmetrically to the weight of a club and so change the "feed" and weight distribution from that originally built into the club. Still further, known devices project pointer means in a sense well beyond or in advance of the ball but do not directly associate a pointer means with the ball. The effectiveness of the prior art indicators in performing their intended function accordingly is reduced.

SUMMARY OF THE INVENTION

The present invention contemplates a direction indicator attachment for golf clubs obviating above named disadvantages. It is light in weight, small in size and removably attaches to a putter head or the like with no need to modify either the club or the indicator device. It is simply and inexpensively made of plastic or thin gauge sheet metal. Its mode of attachment makes it useful either as an optionally installed temporary accessory for practice purposes or as an integrated part of a club for actual play. Pointer means of extended length includes an end portion which overlies the ball in an address thereof, the pointer means providing an elongated line from the ball outwardly thereof assisting the golfer in orienting the club face perpendicular to a line leading directly to the hole in a green and assisting the golfer in stroking the ball along such line.

In illustrated embodiments, the indicator device is made in one-piece of a light weight plastic or like material. Plate or sheet-like in form the device is bifurcated to one end with the legs so defined being bent over at their extremities to be applied at spaced locations to the striking face of the golf club. In advance of their bent over extremities, the bifurcated legs form an aperture to overlie a ball in the address thereof. Toward its other end the device is reduced to form an outwardly directed first pointer portion. What may be regarded as an inward extension of the first pointer portion projects reversely thereof into the aperture between the bifurcated legs. It defines a second pointer portion, aligned with the first, and provides a continuing indication from the actual ball location outwardly thereof of a correct path of travel of the club and of the ball. Simple elastic band means may be used to wrap around the club head and the legs of the indicator device to establish the latter in a releasably assembled relation to the club. In the alternative, and particularly in the case of a blade type putter, the legs may be given a slotted or channeled configuration to fit over an upper edge of the putter head. In either instance, the indicator device is easily applied to and removed from the club head.

An object of the invention is to provide an inexpensive and light weight direction indicator attachment for golf clubs which is easily applied to and removed from the club head.

Another object of the invention is to provide a direction indicator applicable to most types of golf clubs which for its installation does not require a modification in the club head.

A further object of the invention is to provide a direction indicator which in use does not materially alter the "feel" or weight distribution of a golf club to which it is applied.

Still another object of the invention is to incorporate pointer means in an indicator device providing an indication of direction having its origins at the location of the ball in the address thereof.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the accompanying drawings wherein are shown some but obviously not necessarily the only form of embodiment of the invention, FIG. 1 is a view in perspective of a putter pointer in accordance with a first illustrated embodiment of the invention shown mounted to a golf putter and with the assembly so defined shown in a position of address relative to a golf ball;

Like parts are indicated by similar characters of reference throughout the several views.

Figures 1, 2, 3, 4, 5:
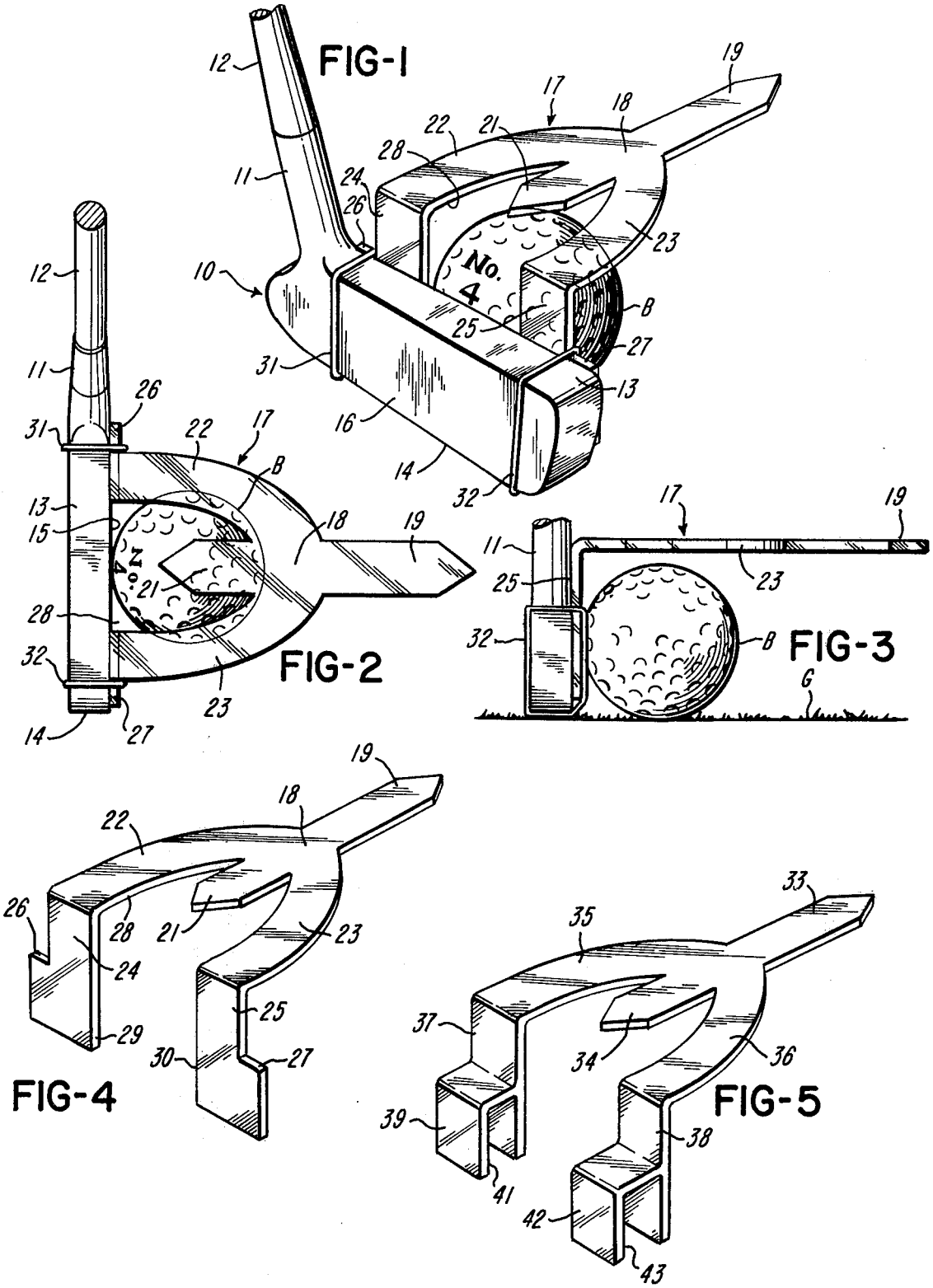
FIG. 2 is a top plan view of the assembly and ball combination of FIG. 1.
FIG. 3 is a view in side elevation of the assembly and ball combination.
FIG. 4 is a detail view in perspective of the putter pointer device of FIGS. 1–3.
FIG. 5 is a perspective view similar to FIG. 4, showing a putter pointer device having an alternate means of mounting to a club head.

Referring to FIGS. 1–4 of the drawings, an indicator device in accordance with a first disclosed embodiment is shown applied to a blade type putter, although at least in connection with the first considered embodiment the shape of the club head is substantially immaterial. The head 10 of a blade type putter has a shank 11 by which it is attached to a shaft 12. The head 10 is generally rectangular and provides upper and lower flat relatively narrow edges 13 and 14. A front face 15 provides a relatively broad and flat striking surface and is approximately perpendicular to edges 13 and 14. A rear face 16 is similarly formed.

The direction indicator is a one-piece body 17 stamped or otherwise formed out of thin guage, light weight material. It is in the illustrated instance made of a clear acrylic plastic, and tends therefore to be durable, to hold its shape and to be substantially transparent. The sheet-like or plate-like form of the body 17 provides an intermediate portion 18 from which pointers 19 and 21 project oppositely of and in line with one another. A pair of legs 22 and 23 originate in intermediate portion 18 and curve therefrom in a generally embracing spaced relation to pointer 21. Near their outer ends, legs 22 and 23 are bent to form dependent extremities 24 and 25 respectively. Laterally projecting feet on the latter form respective upwardly facing shoulders 26 and 27. To its one end, therefore, the indicator body has a bifurcated construction with the bifurcations defining between them an aperture 28, into which aperture pointer 21 extends. Aperture 28 is continuous through the length of the bifurcations or legs 22 and 23 and effectively spaces apart the dependent extremities 24 and 25. Adjacent edges 29 and 30 of the latter are spaced apart a distance readily to allow at least a portion of a golf ball to project therebetween.

Intermediate portion 18, pointers 19 and 21 and legs 22 and 23 are in a common plane with leg extremities 24 and 25 bent out of such plane into another plane substantially perpendicular to the first. The angle of the leg extremities is made substantially to agree with the angle of a surface to which the indicator is to be applied, in this instance striking face 15 of the club head 10.

In installing the indicator device on the club head 10, the leg extremities are seated to front face 15 thereof and suitable retainer means applied to hold the indicator device appropriately positioned. In the illustrated instance, the retainer means are elastic bands 31 and 32 placed in an encircling confining relation to the club head and to the indicator device at the location of shoulders 26 and 27. A single elastic band having slip loops at the location of shoulders 26 and 27 may serve with equal effect. The dependent leg extremities 24 and 25 accordingly seat flushly to the striking face 15 of the club head and are held thereto by light weight simply applied retainer means easily removed for disassembly purposes. The main plate-like portion of body 17 extends at right angles to leg extremities 24 and 25, forwardly of the club head. Pointers 19 and 21 are aligned with one another, and, since they are substantially perpendicular to the plane of extremities 24 and 25, similarly orient relative to face 15. The pointers, when directed at an objective such as the hole in a green, accordingly indicate a path of movement in which the club head should be stroked to insure that a struck ball will be propelled along such path. The arrangement results further in club face 15 being substantially self-adjusting to a position perpendicular to the desired path of movement.

In an assembled position of the device, leg extremities 24 and 25 project the main plate-like portion of body 17 upward to occupy a plane above club edge 13. In an address of the ball with both club head 10 and a ball B resting on a supporting surface G, the plate portion occupies a position above ball B and in vertically spaced approximately parallel relation to surface G. A portion of the ball projects through or between leg extremities 24 and 25 to be contacted by club face 15. From above, the ball can be seen through aperture 28. Pointer 21 extends into the aperture 28 and projects toward the plane of leg extremities 24 and 25 a sufficient distance to overlie the ball. The result is to establish a continuing indicated path of travel, through the combined effects of pointers 19 and 21, which originates at the location of the ball and extends an appreciable distance outwardly thereof. The elongated nature of the rearwardly directed pointer portion 21 permits the ready and precise reference thereof not only to the ball and the striking face of the club but to a rearwardly positioned landmark as the first pointer portion 19 is referenced to the hole or flag to which it is desired to hit the ball. This is highly advantageous in that it extends the line of sight along which it is desired to move the ball and results in greater accuracy in executing a stroke. Conditions decidedly favorable to an accurately controlled positioning and stroking of the club accordingly are provided.

In mounting the indicator device to the club head, a correct vertical and angular orientation thereof may be assured by holding the device to the face 15 with shoulders 26 and 27 at the level of edge 13 while elastic band means are applied. If desired, the leg extremities could be formed with integral lip or flange means adapted to limit against edge 13 for a self-locating of the indicator device in both vertical and angular senses.

The indicator device of FIG. 5 is the same in all respects as that of FIGS. 1–4 except for the means for removably attaching it to the club head. Thus, it comprises first and second pointer means 33 and 34 and bifurcated legs 35 and 36 terminating in bent over extremities 37 and 38. In the case of the FIG. 5 embodiment, however, extremity 37 has an integrally formed right angle part 39 defining therewith a channel 41 opening downwardly and to the sides. Extremity 38 includes a like part 42 defining therewith a like channel 43. Channels 41 and 43 are aligned with one another and have a front to back dimension corresponding approximately to the thickness of putter head 10 or more particularly to the front to back dimension of edge 13. As will be evident, the device of FIG. 5 is installed merely by slipping extremities 37 and 38 over club head edge 13 whereupon the latter seats in the channels 41 and 43. The bottoms of the channels, in making contact with edge 13, position the device in vertical and angular senses. Front and back walls of the channels, as defined by dependent portions of parts 39 and 42 and opposing portions of extremities 37 and 38, make a sliding contact with faces 15 and 16. The relatively wide spacing of extremities 37 and 38 provide for a stable mounting of the indicator device on the putter head and assure that an adequate area of face 15 in a mid portion thereof is exposed for contact with a ball. The indicator device is removed from the putter head merely by lifting it therefrom. In its structural features, other than as noted, and in its utility, the device of FIG. 5 is the same as that of FIGS. 1–4.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. A direction indicator for a golf club comprising a plate-like object including a first portion and a second portion, said first portion being bent at substantially a right angle to said second portion and providing means to be placed in contact with at least one face of the head of a golf club to position said second portion to project outwardly of the striking face of the club and in overlying relation to a golf ball positioned adjacent the striking face, said plate-like object being formed to provide an opening in said second portion through which said golf ball may be observed, within the limits of which opening projects a portion of the plate-like object which defines a first pointer the projected extremity of which will terminate over a ball properly positioned at the striking face of said club, and a second pointer, said first and second pointers being directly aligned and oppositely projected to provide that one thereof may be directed towards a hole or flag while the other thereof is directed to a landmark positioned rearwardly of the striking face of the club, to provide thereby a line of sight through which the head of the club should be swung in moving the golf ball to the hole or flag.

2. A direction indicator according to claim 1 wherein said plate-like object is formed from a flat plate to produce therein, at one end thereof, a pair of leg-like portions at least the projected extremities of which are bent from the plane of said plate to provide said first portion which is formed to assist in a removable attachment thereof to the head of a golf club.

3. A direction indicator as in claim 2 characterized in that said leg-like portions are extended from said first portion to form part of said second portion of said plate-like object and to define therebetween said opening in said second portion.

4. A direction indicator as in claim 3 characterized in that said first pointer lies within the boundary of said second portion to extend between and substantially co-planar with said extensions of said leg-like portions which form part of said second portion of said indicator.

5. A direction indicator as in claim 2 characterized in that said leg-like portions have the projected extremities thereof provided with projections defining points for a slip fit application of elastic connector means to clamp said projected extremities of said leg-like portions to said one face of said golf club.

6. A direction indicator as in claim 2 characterized in that the projected extremities of said leg-like portion which are remote from said second portion are formed to provide downwardly opened channel means for receiving therein the upper edge of the head of a golf club which has a blade-like form.

7. A direction indicator for removable attachment to the head of a golf club to assist in placing its striking face perpendicular to a desired line of travel of a golf ball and in indicating such line of travel, said indicator comprising a plate-like object having forwardly and rearwardly directed pointers one of which forms an axial extension of and is co-planar with the other, said plate-like object including a pair of legs commonly connected with said pointers intermediate their oppositely projected extremities and extending therefrom in generally embracing spaced relation to said rearwardly directed pointer, the projected extremities of said legs being bent over to form generally right angled extremities adapted to be placed in flush mating contact with the head of a golf club, said extremities of said legs being so angled to provide that as they are placed in mating contact with said head of the golf club said pointers may be positioned in a line which is in an overlying bisecting relation to a golf ball positioned at the striking face of said club to locate the projected extremity of said rearwardly directed pointer over the golf ball to provide thereby an extended line of sight one end of which, defined by the projected extremity of said forwardly directed pointer, may be referenced to a hole or flag and the other end of which, defined by the projected extremity of said rearwardly directed pointer positioned at said golf ball, may be referenced to a landmark positioned rearwardly of the striking face of the club.

8. A direction indicator according to claim 7, wherein the portions of said legs other than their bent over extremities are in a plane commonly occupied by said forwardly and rearwardly directed pointers.

9. A direction indicator according to claim 7 wherein said leg extremities are in a spaced apart relation and provided with relatively adjacent and relatively remote side edges and said remote side edges of said legs are each formed with a laterally projecting foot, said laterally projecting feet being aligned and forming upwardly facing shoulders and facilitating the releasable application of said indicator to the head of a golf club by slip fit attachment means.

10. A direction indicator for a golf club comprising a plate-like object including a first portion and a second portion, said first portion being bent at substantially a right angle to said second portion and providing means to be placed in contact with at least one face of the head of a golf club to position said second portion to project outwardly of the striking face of the club and in overlying relation to a golf ball positioned adjacent the striking face, said plate-like object being formed to provide an opening in said second portion through which said golf ball may be observed, means defining a first pointer at one extremity of said second portion and an oppositely directed second pointer, at least a part of said second pointer being disposed to overlie the golf ball observed through said opening, said plate-like object being made of a single piece of a clear lightweight plastic material of flat planar construction and said first portion being an end portion of the object which is bent from the plane of said second portion, said pointers being in the plane of said second portion and said first and second pointers being directly aligned and oppositely projected to provide that one thereof may be directed towards a hole or flag while the other thereof is directed to a landmark positioned rearwardly of the striking face of the club, to provide thereby a line of sight through which the head of the club should be swung in moving the golf club to the hole or flag.

* * * * *

UNITED STATES PATENT AND TRADEMARK OFFICE

CERTIFICATE OF CORRECTION

PATENT NO. : 4,002,343

DATED : January 11, 1977

INVENTOR(S) : Albin F. Eckert

It is certified that error appears in the above-identified patent and that said Letters Patent are hereby corrected as shown below:

Col. 1, line 17, "feed" should be corrected to read --"feel"-- .

Col. 2, line 54, "guage" should be corrected to read -- gauge --.

Col. 5, line 42 (Claim 6, line 2) "portion" should be corrected to read -- portions --.

Signed and Sealed this

Twelfth Day of April 1977

[SEAL]

*Attest:*

RUTH C. MASON
*Attesting Officer*

C. MARSHALL DANN
*Commissioner of Patents and Trademarks*